US008757276B2

(12) United States Patent
Alff et al.

(10) Patent No.: US 8,757,276 B2
(45) Date of Patent: Jun. 24, 2014

(54) SYSTEM AND METHOD FOR CONNECTING COMMUNICATION LINES IN A WELL ENVIRONMENT

(75) Inventors: Michael Alff, Sugar Land, TX (US); Robert Speers, Spring, TX (US); Emmanuel Rioufol, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 476 days.

(21) Appl. No.: 12/487,228

(22) Filed: Jun. 18, 2009

(65) Prior Publication Data

US 2010/0319931 A1 Dec. 23, 2010

(51) Int. Cl.
*E21B 23/00* (2006.01)

(52) U.S. Cl.
USPC ..... 166/378; 166/85.1; 166/385

(58) Field of Classification Search
USPC ..... 166/378, 85.1, 385, 243, 248
See application file for complete search history.

(56) References Cited

U.S. PATENT DOCUMENTS

| | | | | |
|---|---|---|---|---|
| 6,752,397 | B2 | 6/2004 | Kohli | |
| 6,886,391 | B2 | 5/2005 | Kohli | |
| 6,919,512 | B2 | 7/2005 | Guven | |
| 7,216,719 | B2 | 5/2007 | Ahmed | |
| 7,220,067 | B2 | 5/2007 | Rubinstein | |
| 7,340,819 | B2 | 3/2008 | Guven | |
| 7,503,395 | B2 | 3/2009 | Meijer | |
| 2004/0194955 | A1 | 10/2004 | Kohli | |
| 2005/0213898 | A1 | 9/2005 | Rubinstein | |
| 2005/0279442 | A1 | 12/2005 | Guven | |
| 2005/0281511 | A1 * | 12/2005 | Ringgenberg et al. | 385/70 |
| 2006/0180305 | A1 * | 8/2006 | Gambier et al. | 166/250.01 |
| 2006/0196660 | A1 | 9/2006 | Patel | |
| 2006/0243454 | A1 | 11/2006 | Bolze | |
| 2006/0260817 | A1 | 11/2006 | Meijer | |
| 2007/0062710 | A1 | 3/2007 | Pelletier | |
| 2007/0237467 | A1 | 10/2007 | Rubinstein | |
| 2009/0056947 | A1 | 3/2009 | Du | |

* cited by examiner

*Primary Examiner* — Yong-Suk (Philip) Ro
(74) *Attorney, Agent, or Firm* — David J. Groesbeck; Brandon S. Clark

(57) ABSTRACT

A technique enables the efficient connection of communication lines in a well application by substantially reducing online rig assembly time. The technique reduces online time of the rig by sealably fastening a first connector of a downhole connection assembly to a segment of a communication line during offline assembly time to substantially reduce the online time requirements. The first connector is later connected to a corresponding second connector while the rig is online to complete the downhole connection assembly that joins communication line segments.

22 Claims, 4 Drawing Sheets

SYSTEM AND METHOD FOR CONNECTING COMMUNICATION LINES IN A WELL ENVIRONMENT

BACKGROUND

The following descriptions and examples are not admitted to be prior art by virtue of their inclusion in this section.

In a variety of well related applications, communication lines are used to convey many types of signals, such as electrical signals, fiber optic light signals, hydraulic signals, and other types of signals to or from downhole locations. For example, the communication lines can be used to transmit data on downhole conditions to a surface control system. The communication lines also can be used to send control signals or other information downhole from the surface. In some applications, the communication lines are used to transmit electrical signals, such as electric power signals, to power downhole equipment.

The communication lines are deployed downhole in conjunction with well strings, e.g. tubing strings, used to convey tool assemblies downhole for many types of servicing operations, production operations, and other well related operations. The communication lines and tool assembly may be conveyed downhole by a rig deployed at a surface location above the well. Rig time is a valuable commodity, and operation of the rig can result in substantial costs. Online rig assembly time, referred to as "online" is the operating time in which the critical path for a rig is governed by the tool assembly at substantial cost. In contrast, offline assembly time, referred to as "offline" is any equipment assembly time in which the critical path for the rig is not governed by the tool assembly. The offline time is much less expensive than the online time.

Each communication line typically is deployed in segments as the tool assembly is conveyed downhole. The segments of communication line may be connected by field weldable connectors that are welded to each communication line segment and then to each other during online rig assembly time. However, formation of the field weldable connectors substantially increases the online rig assembly time which, in turn, substantially increases the expense and the difficulty of routing communication lines over substantial distances through the wellbore.

SUMMARY

In general, the present invention provides a technique for efficiently connecting communication lines in a well application by substantially reducing online rig assembly time. The technique reduces online time by sealably fastening a first connector of a downhole connection assembly to a segment of a communication line during offline assembly time to substantially reduce the online time requirements. The first connector is then connected to a corresponding second connector while the rig is online to complete the downhole connection assembly that joins communication line segments.

Other or alternative features will become apparent from the following description, from the drawings, and from the claims.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

Figure 1:
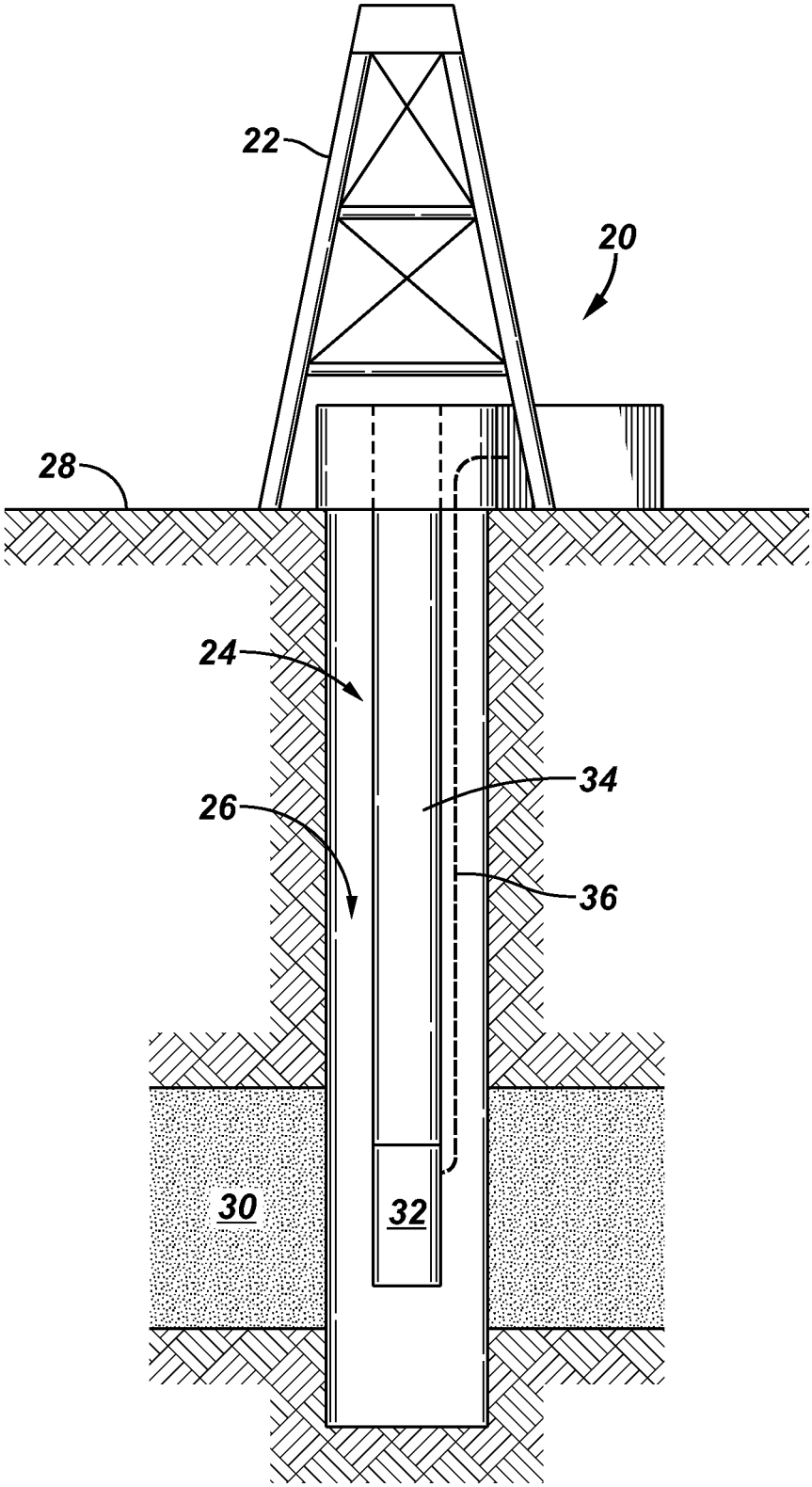
FIG. 1 is a schematic illustration of one example of a tool assembly and a communication line conveyed downhole via a rig, according to an embodiment of the present invention.

In the following description, numerous details are set forth to provide an understanding of the present invention. However, it will be understood by those of ordinary skill in the art that the present invention may be practiced without these details and that numerous variations or modifications from the described embodiments may be possible.

The present invention generally involves a system and methodology to facilitate the formation of communication line connections that can be used in subterranean environments. In well related applications, the communication line connections are substantially premade offline to reduce online rig assembly time. One or both halves of a downhole connector assembly may be sealably fastened, e.g. welded, to a communication line during offline assembly time. This premaking of at least a portion of the communication line connection substantially increases the efficiency of rig usage. It should be noted at least some of the communication line connection embodiments described herein also can be used to improve the efficiency of well related applications that do not involve rig time.

The system and methodology for forming communication line connections are useful with a variety of signal carriers, including those for carrying electrical signals, fiber optic (light) signals, hydraulic signals, and other communication line signals. In the description below, a downhole connector assembly may be used to connect segments of a communication line. The signal carrying components of each communication line segment located within the downhole connector assembly are referred to as the "core", and the connection between two cores within the downhole connector assembly is referred to as a splice.

According to one specific example, the downhole connector assembly is formed with two connectors that are sealably attached, e.g. welded or otherwise mechanically sealed, to adjacent, corresponding segments of the communication line. Each connector comprises a splice coupling with internal core components. Once the splice couplings are attached, e.g. welded, to the corresponding communication line segments and the core of each side is prepared for splicing, a splice is made between the cores. The splice couplings are then sealably attached, e.g. welded, to each other to complete the downhole connector assembly. Connection of one or both splice couplings to the corresponding communication line segments, as well as preparation of one or both cores, is accomplished during offline assembly time.

The splices/connections can be formed in various configurations. For example, the downhole connector assembly may be constructed by preparing one of two communication line segments during offline assembly time. In this embodiment, one communication line connector is prepared and welded to the communication line offline before the full connection is formed. The assembler of the communication line connection prepares the free end of one communication line segment by welding a connector to the communication line segment during offline time. In other configurations, the splice/connection can be formed by preparing both adjacent communication line segments during offline assembly time. The assembler of the connection prepares the free end of both communication line segments by welding corresponding connectors to the communication line segments during offline time. It should be noted that instead of welding, other techniques, e.g. adhering or employing a separate mechanical seal, can be used to form the various sealed connections.

Referring generally to FIG. 1, an example of a well related application is illustrated. In this example, a well system 20 comprises a rig 22 used to deliver well equipment 24 downhole into a wellbore 26. Rig 22 is positioned at a surface location 28, such as a land surface location, from which wellbore 26 is drilled down through one or more subterranean formations 30. Depending on the specific application, well equipment 24 may comprise a variety of components and assemblies used in a variety of servicing operations, production operations, or other well related operations. As illustrated, well equipment 24 comprises a tool assembly 32 delivered downhole with a well string 34, such as the tubing string, to a desired location in wellbore 26.

The well equipment 24 also comprises one or more communication lines 36 that can be used to convey signals downhole to tool assembly 32 and/or uphole from tool assembly 32. The communication lines 36 may be designed to transmit data and/or power as needed for a desired well application. Additionally, the communication lines 36 can be used to carry signals to or from a variety of other devices/locations in wellbore 26. As tool assembly 32 is conveyed downhole, additional segments of the communication line 36 are connected with a suitable downhole connector assembly, as described in greater detail below.

Figure 2:
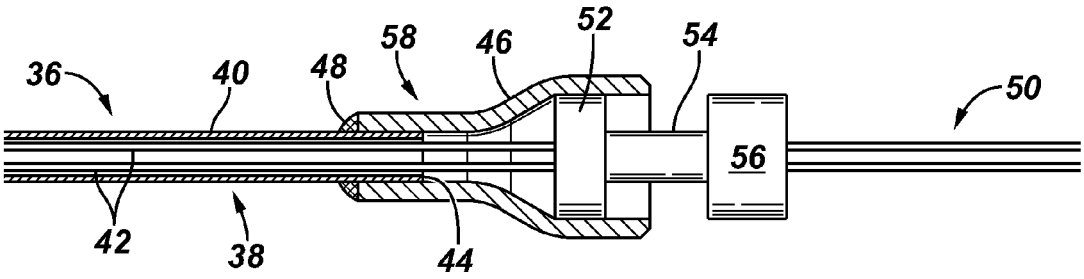
FIG. 2 is a schematic view of one example of a communication line connector for use in forming a downhole connector assembly, according to an embodiment of the present invention.
Figure 3:
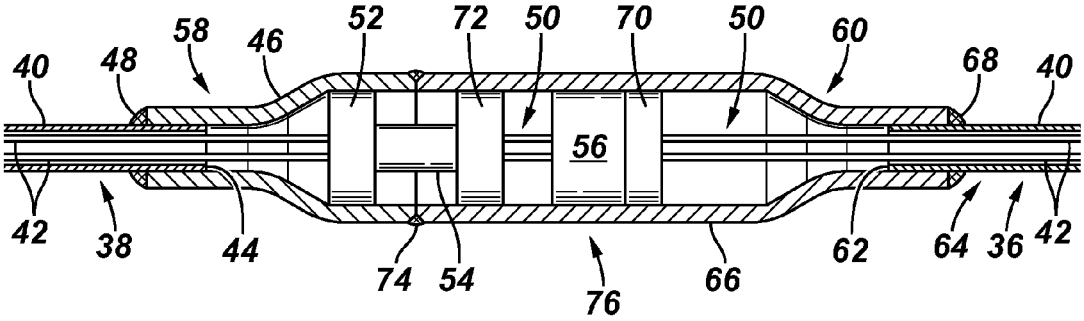
FIG. 3 is a schematic view of the communication line connector illustrated in FIG. 2 joined to a corresponding communication line connector, according to an embodiment of the present invention.

Referring generally to FIGS. 2 and 3, one embodiment of a system for connecting/splicing communication lines is illustrated. In FIG. 2, one half of the connection is illustrated as being prepared using offline assembly time. In this embodiment, a communication line segment 38 of communication line 36 comprises an outer housing or jacket 40 enclosing one or more signal carriers 42, e.g. electrical, fiber-optic and/or hydraulic, able to carry signals downhole and/or uphole as desired for a given well application. In many applications, the outer housing 40 may be formed of a metal material, e.g. steel.

During offline time, a connection end 44 of communication line segment 38 is prepared to receive a splice coupling 46 which is slid over connection end 44 and sealably fastened to the outer housing 40. By way of example, splice coupling 46 may be sealably fastened to outer housing 40 via a suitable fastening mechanism 48, such as a weldment or another type of mechanical seal. The signal carriers extending into the interior of splice coupling 46 for splicing to corresponding signal carriers can be referred to as a core or cores 50 and various core related components can be used to facilitate the internal splice of signal carriers. For example, a spacer 52 and a core protection member 54 may be disposed within splice coupling 46 over signal carriers 42. Additionally, a core splice member 56 also may be coupled to the core 50 to facilitate splice formation when attached to the corresponding communication line segment. The splice coupling 46 and the internal core and core components comprise a first connector 58 that is assembled offline for later connection to a corresponding or second connector 60, an embodiment of which is illustrated in FIG. 3.

In this particular example, second connector 60 is prepared while the rig 22 is online, and the connection of first connector 58 and second connector 60 also is accomplished during online rig time. A connection end 62 of a corresponding communication line segment 64 is prepared to receive a second or corresponding splice coupling 66 which is slid over connection end 62 and sealably fastened to the outer housing 40. By way of example, splice coupling 66 may be sealably fastened to outer housing 40 via a suitable fastening mechanism 68, such as a weldment or another type of mechanical seal. Additionally, the internal splice of signal carriers 42/core 50 is achieved by joining core splice member 56 with a corresponding core splice member 70. Additionally, a second spacer 72 can be positioned around the core 50 within splice coupling 66, as illustrated. By way of example, the weldment 68 may be formed after insertion of second spacer 72 and after joining of splice members 56, 70.

Once the signal carriers 42 are spliced within the splice couplings 46, 66, the splice couplings 46, 66 can be joined by a suitable connection technique. The connection technique is designed to form a seal to protect the internal splice. By way of example, splice coupling 46 may be connected to the corresponding splice coupling 66 by welding and formation of a suitable weldment 74. Splicing the core and joining splice couplings 46, 66 results in formation of a downhole connector assembly 76.

Figure 4:
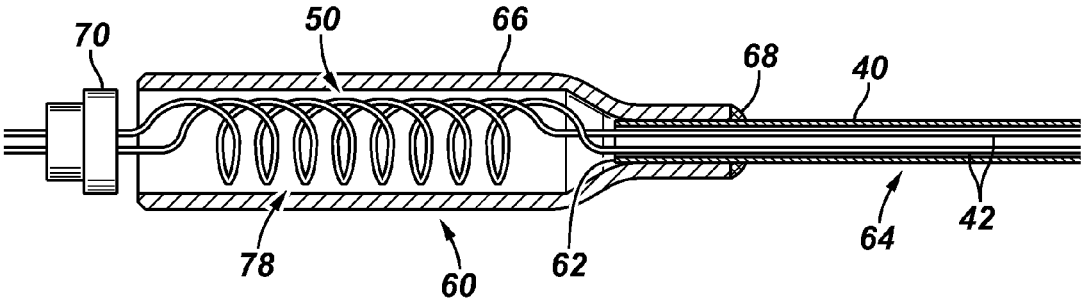
FIG. 4 is a schematic view of another example of a communication line connector for use in forming a downhole connector assembly, according to an alternate embodiment of the present invention.

In an alternate embodiment, both connector 58 and connector 60 are formed during offline assembly time. In FIG. 4, connector 60 is illustrated in a form amenable to preparation offline. Consequently, the only assembly work required during online rig time is the actual splicing of the cores 50 and joining of connectors 58 and 60. In this example, the first connector 58 can be assembled as described above with respect to FIG. 2, however second connector 60 is prepared according to an alternate technique.

Referring again to FIG. 4, the connection end 62 of communication line segment 64 is initially prepared for receiving splice coupling 66. The core 50 is then prepared for creation of a splice connection by, for example, adding corresponding core components, such as core splice member 70. The exposed core 50, e.g. electrical lines, is then coiled into a coil 78 of fixed length and diameter. Subsequently, the splice coupling 66 is slid over the coil 78 while stretching the coil 78 to an extended configuration. Once slid over end 62, the splice coupling 66 is sealably fastened to the outer housing 40 of the communication line segment 64. By way of example, the splice coupling 66 can be fastened to outer housing 40 via fastening mechanism 68, e.g. via welding and formation of a weldment. Once this portion of the assembly is completed, the second connector 60 is in the form illustrated in FIG. 4.

Figure 5:
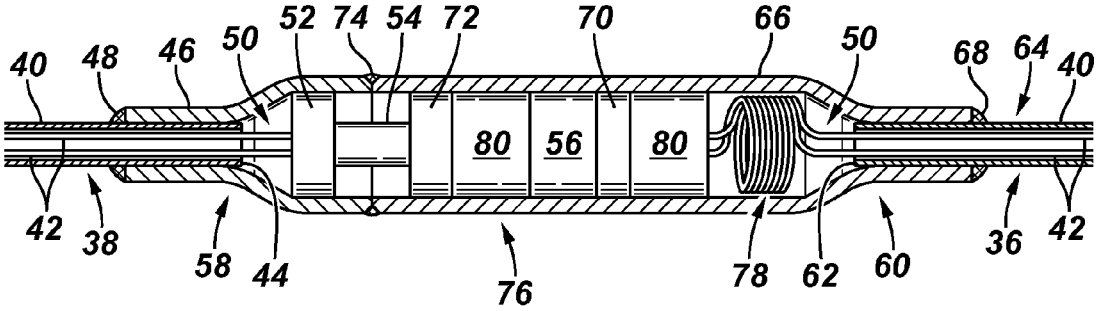
FIG. 5 is a schematic view of the communication line connector illustrated in FIG. 4 joined to a corresponding communication line connector, according to an alternate embodiment of the present invention.

Following offline creation of connector 60, the downhole connector assembly 76 can be completed during online rig time. According to one approach, spacers 80 are installed on both sides of core splice members 56, 70, and the core splice members 56, 70 are engaged, as illustrated in FIG. 5. The core splice members 56, 70 are slid into splice coupling 66 to compress coil 78 and to enable engagement of splice coupling 46 with splice coupling 66. The splice couplings 46, 66 are then sealably joined by a suitable connection technique, such as welding.

Figure 6:
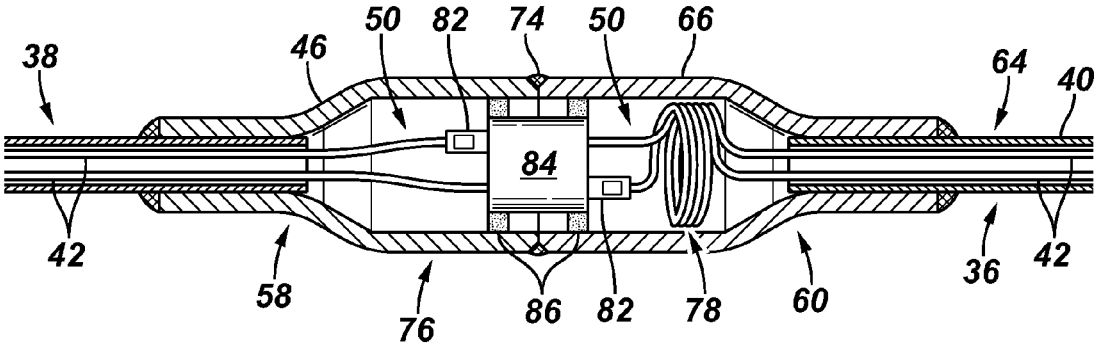
FIG. 6 is a schematic view of another embodiment of a downhole connector assembly, according to an embodiment of the present invention.

Referring generally to FIG. 6, an alternate embodiment of downhole connector assembly 76 is illustrated. In this embodiment, one side of the downhole connector assembly 76 is premade during offline time. For example, connector 60 can be premade by coiling the core 50 to form coil 78 within splice coupling 66. Additionally, this configuration utilizes core splices 82 that may be in the form of single boots, e.g. two single boots 82, to splice the core 50 within splice couplings 46, 66. The coil 78 allows the core splice to be fed back into splice coupling 66 following splicing of the core via core splices 82. Additionally, a core protection 84 and corresponding spacers 86 may be used to protect the core splice. In this embodiment, a single boot splice 82 is located on each longitudinal side of core protection 84 to provide a staggered configuration.

Figure 7:
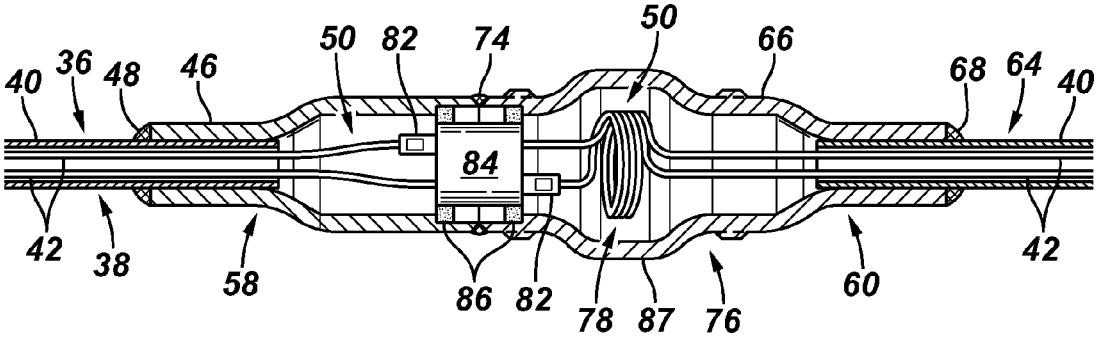
FIG. 7 is a schematic view of another embodiment of a downhole connector assembly, according to an embodiment of the present invention.

Generally, this embodiment enables the complete premaking of one connector, e.g. connector 60, while the other connector is completed online. The connector 58 is completed online because the sealable connection, e.g. weld, is not formed between splice coupling 46 and communication line segment 38 until after the core splice is formed. In a related embodiment, splice coupling 66 is formed with an expanded section 87 to better accommodate the coil 78, as illustrated in FIG. 7.

Figure 8:
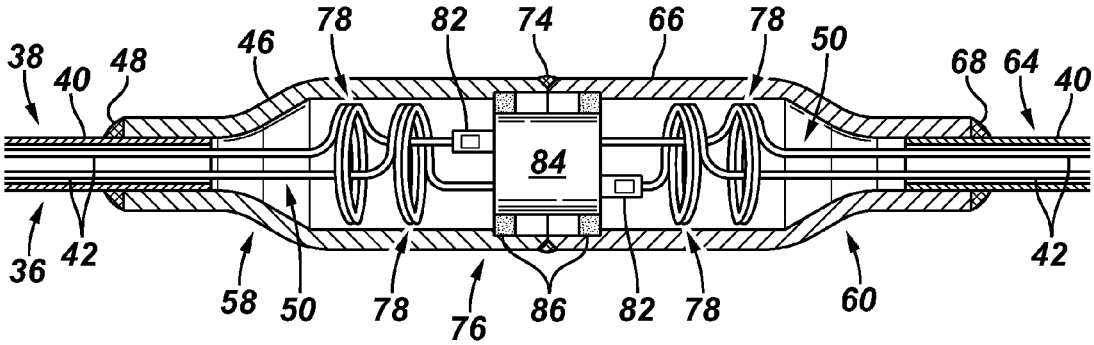
FIG. 8 is a schematic view of another embodiment of a downhole connector assembly, according to an embodiment of the present invention.

In FIG. 8, another embodiment of downhole connector assembly 76 is illustrated. In this embodiment, both sides of the connector assembly 76 can be premade during offline time. The signal carriers in the core 50 are coiled into individual coils 78, and splice couplings 46, 66 are slid over the coils 78 and corresponding communication line connection ends 44, 62, (see FIG. 3) respectively. The splice couplings 46, 66 are then welded or otherwise sealably fastened to the respective communication line segments. By way of example, core 50 may comprise two signal carriers to be spliced, resulting in four coils 78, as illustrated.

After forming each connector 58 and 60 offline, the actual splicing of communication line segments occurs online. The core of each connector is extended via coils 78 to enable splicing of the signal carriers via suitable core splices, such as splices 82. Once connected, the core splices 82 are pushed back into their respective splice couplings in a staggered arrangement, as illustrated in FIG. 8. For example, each core splice 82 may be positioned on an opposite side of core protection 84 and corresponding spacers 86. In some downhole connector assemblies 76, the staggered arrangement helps accommodate the size of the core splices 82. Once the core splices are inserted back into the corresponding splice couplings, the splice couplings 46 and 66 are sealably connected by weldment 74 or by another suitable fastening mechanism.

Figure 9:
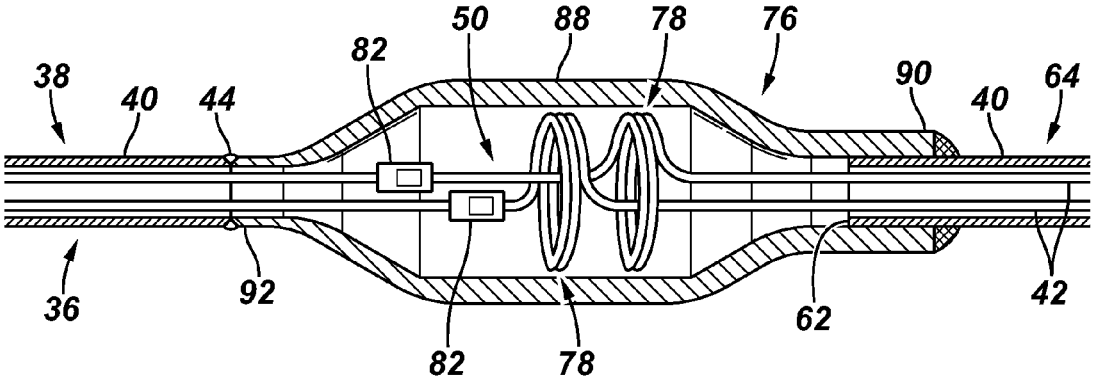
FIG. 9 is a schematic view of another embodiment of a downhole connector assembly, according to an embodiment of the present invention.

Referring generally to FIG. 9, another embodiment of downhole connector assembly 76 is illustrated. In this embodiment, the connector assembly 76 is constructed with only two locations at which a seal, e.g. a weld, must be formed. In this example, coils 78 are again formed with the signal carriers of core 50. For example, two coils 78 may be formed if there are two signal carriers in the core 50, as in the illustrated embodiment. The coils 78 are then expanded to enable a unitary housing 88 to be slid over the coils 78 and onto connection end 62 of communication line segment 64. A first end 90 of housing 88 is then sealably fastened, e.g. welded, to communication line segment 64 during offline assembly time. The connection end 44 of communication line segment 38 also can be prepared during offline assembly time.

Once both sides are prepared, the core splices are formed and pushed back into unitary housing 88 during online rig assembly time. The core splices 82 may be positioned in a staggered arrangement which enables use of smaller diameters in the openings of unitary housing 88, such as shown in the second end 92 for example. Following movement of the core splices 82 into housing 88, the second end 92 of housing 88 is sealably fastened, e.g. welded, to the connection end 44 of communication line segment 38 to complete downhole connector assembly 76.

Figure 10:
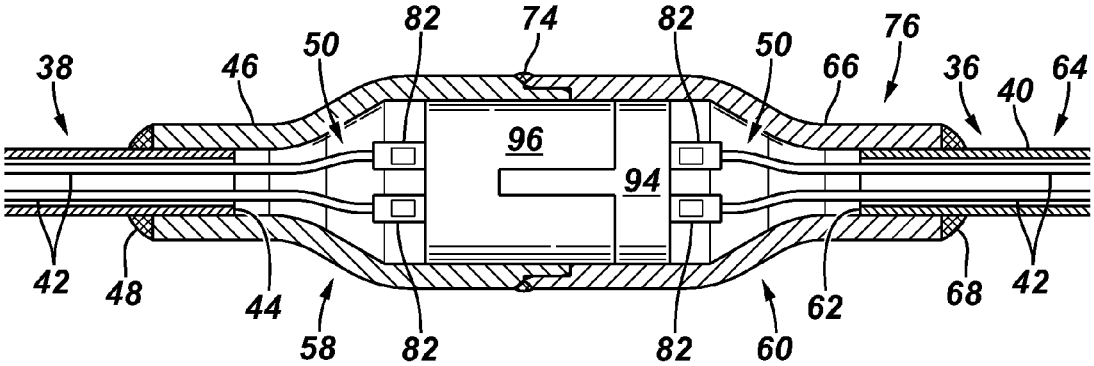
FIG. 10 is a schematic view of another embodiment of a downhole connector assembly, according to an embodiment of the present invention.

In FIG. 10, another embodiment of downhole connector assembly 76 is illustrated. In this embodiment, the core splice is formed inside splice couplings 46, 66 via engagement of a first mechanical core splice connector 94 with a second mechanical core splice connector 96. By way of example, first mechanical core splice connector 94 may comprise a male connector received by second mechanical core splice connector 96 in the form of a female connector. The signal carriers 42 of core 50 within splice coupling 66 can be connected to first mechanical splice connector 94 via core splice members 82. Similarly, the signal carriers 42 of the core 50 within splice coupling 46 can be connected to second mechanical splice connector 96 via core splice members 82, as illustrated.

Each connector 58, 60 may be premade offline by splicing the signal carriers of the core 50 to the corresponding mechanical connectors 94, 96 and then sliding the corresponding splice couplings 66, 46, respectively, over the mechanical connectors. The splice couplings 66, 46 are then welded or otherwise sealably fastened to communication line segments 64, 38 of communication line 36. Subsequently, the online formation of downhole connector assembly 76 may be completed by engaging mechanical core splice connectors 94 and 96 followed by sealably fastening the splice connectors 46, 66 via a suitable fastening mechanism 74, such as weldment or a separate mechanical seal. As illustrated, the splice couplings 46 and 66 may have overlapping portions to facilitate sealing engagement.

Examples of techniques for connecting communication lines have been provided, but the connection components and the procedures for forming the connections may vary for different well applications and for other types of applications. In some applications, the coils, spacers, and/or core protection can be individually omitted or substituted with other components. Although the various techniques are useful in increasing the efficiency of forming connections by reducing online rig assembly time, the techniques also can be used in some situations to form both sides of the connector assembly independently of each other while online. Depending on the application, the core and core components may be constructed in a number of different forms, including arranging the core in loops and/or providing compressible telescoping core components to allow for length compensation.

If one or more of the signal carriers comprises a hydraulic control line, the core components may be altered, interchanged or omitted to accommodate the tubing type signal carrier. The connector assemblies also may be designed to accommodate single, dual, or multiple signal carriers that form the internal cores. Furthermore, in addition to welding, other fastening techniques can be used to create sealed connections. Examples of those fastening techniques include compression seals, cone-type pressure connections, epoxy sealed joints, and other suitable fasteners.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method for efficiently coupling a communication line for use in a wellbore, comprising:

providing a first weldable connector and a second weldable connector to enable formation of a downhole connector assembly to be delivered downhole with a tool assembly into a wellbore via a rig during online rig assembly time;

welding at least one of the first weldable connector and the second weldable connector to a communication line during offline assembly time; and subsequently completing the downhole connector assembly with the tool assembly during the online rig assembly time comprising splicing a first core side of the first weldable connector to a second core side of the second weldable connector, wherein:

the offline assembly time is assembly time when the critical path of the rig is not governed by the tool assembly; and the online rig assembly time is assembly time when the critical path of the rig is governed by the tool assembly.

2. The method as recited in claim 1, wherein welding comprises welding both the first weldable connector and the second weldable connector to corresponding segments of the communication line during the offline assembly time.

3. The method as recited in claim 1, wherein welding comprises welding a first splice coupling of the first weldable connector to the communication line to form a seal with the communication line; and further comprising attaching a core protection and a spacer into the first splice coupling during the offline assembly time and further comprising adding a first core splice member to the first core side.

4. The method as recited in claim 3, wherein welding comprises preparing the second weldable connector during the online rig assembly time; and further comprising welding the second weldable connector to the first splice coupling of the first weldable connector during the online rig assembly time.

5. The method as recited in claim 3, further comprising preparing the second weldable connector during the offline assembly time by:

preparing the second core side for a splice connection, comprising adding a second core splice member to the second weldable connector;

coiling the second core side into a coil; and sliding a second splice coupling over the coil while stretching the coil prior to welding the second splice coupling to the communication line.

6. The method as recited in claim 5, wherein subsequently completing comprises connecting the first core splice member and the second core splice member and welding the first splice coupling to the second splice coupling to complete the downhole connector assembly during the online rig assembly time.

7. The method as recited in claim 1, further comprising utilizing a pair of single boots to make core splices in the downhole connector assembly.

8. The method as recited in claim 1, further comprising arranging a plurality of staggered core splices in the downhole connector assembly.

9. The method as recited in claim 1, further comprising:

coiling and expanding the first core side and the second core side during the offline assembly time;

welding an end of a unitary housing to the communication line;

pushing the pair of the first core side and the second core side into the unitary housing; and welding a second end of the unitary housing to the communication line during the online rig assembly time.

10. The method as recited in claim 1, further comprising utilizing mechanical core splice connectors to form a splice within the downhole connector assembly.

11. A method for efficiently coupling a communication line for use in a wellbore, comprising:

forming a downhole connector assembly by fastening a first connector to a first segment of a communication line and a second connector to a second segment of the communication line during offline assembly time; and connecting the first connector to the second connector to couple the communication line segments and thus complete the downhole connector assembly with a tool assembly during online rig assembly time, wherein:

the offline assembly time is assembly time when the critical path of the rig is not governed by the tool assembly; and the online rig assembly time is assembly time when the critical path of the rig is governed by the tool assembly.

12. The method as recited in claim 11, further comprising delivering the downhole connector assembly into a wellbore via the rig.

13. The method as recited in claim 11, wherein forming comprises welding a first splice coupling of the first connector to the first segment and a second splice coupling of the second connector to the second segment.

14. The method as recited in claim 11, wherein connecting comprises welding the first connector to the second connector.

15. The method as recited in claim 11, further comprising coiling a signal carrying core to accommodate a signal carrier connection inside the downhole connector assembly.

16. The method as recited in claim 11, further comprising arranging a plurality of staggered core splices in the downhole connector assembly.

17. The method as recited in claim 11, further comprising utilizing mechanical core splice connectors to provide a connection of signal carriers within the downhole connector assembly.

18. A method for efficiently coupling a communication line for use in a wellbore, comprising:

reducing online rig assembly time-of a rig by sealably fastening a first connector of a downhole connector assembly to a segment of a communication line during offline assembly time, wherein the first connector comprises a first core side having a first core splice member;

assembling during offline assembly time a second connector to a segment of the communication line, the second connector comprising a second core side formed in a coil and having a second core splice member;

connecting the first connector to the second connector during the online rig assembly time to complete the downhole connector assembly thereby joining segments of the communication line with a tool assembly, wherein:

the offline assembly time is assembly time when the critical path of the rig is not governed by the tool assembly; and the online rig assembly time is assembly time when the critical path of the rig is governed by the tool assembly.

19. The method as recited in claim 18, further comprising sealably fastening the corresponding second connector to a corresponding segment of the communication line during the offline assembly time.

20. The method as recited in claim 18, wherein sealably fastening the first connector comprises welding the first connector to the segment.

21. The method as recited in claim 18, wherein sealably fastening the second connector comprises welding the second connector to the corresponding segment.

22. The method of claim 18, wherein the connecting the first connector to the second connector during the online rig assembly time comprises:

engaging the first core splice member to the second core splice member;

sliding the first and the second engaged core splice members inside of the second connector thereby compressing the coil; and welding the first connector to the second connector.

* * * * *